United States Patent [19]

Nakayama et al.

[11] 4,456,670

[45] Jun. 26, 1984

[54] PHOTOSENSITIVE MATERIAL FOR LITHOGRAPHIC PRINTING

[75] Inventors: Takao Nakayama; Chikashi Ohishi; Sho Nakao; Keisuke Shiba, all of Shizuoka, Japan

[73] Assignee: Fuji Photo Film Co., Ltd., Minami-ashigara, Japan

[21] Appl. No.: 405,773

[22] Filed: Aug. 6, 1982

[30] Foreign Application Priority Data

Aug. 6, 1981 [JP] Japan ..... 56-123325

[51] Int. Cl.[3] ..... G03G 13/32

[52] U.S. Cl. ..... 430/49; 430/63; 430/302

[58] Field of Search ..... 430/49, 63, 302

[56] References Cited

U.S. PATENT DOCUMENTS

| | | | |
|---|---|---|---|
| 3,198,632 | 8/1965 | Kimble et al. . | |
| 3,607,255 | 9/1971 | Back | 430/49 |
| 3,720,514 | 3/1973 | Howjo et al. | 430/63 |

*Primary Examiner*—John E. Kittle
*Assistant Examiner*—John L. Goodrow
*Attorney, Agent, or Firm*—Sughrue, Mion, Zinn, Macpeak & Seas

[57] ABSTRACT

A photosensitive material for lithographic printing comprising a photosensitive layer, an aluminum foil and a paper base in that order. An intermediate layer containing colloidal silica and/or colloidal alumina is formed between the photosensitive layer and the aluminum foil. The material has good stability and can produce a large number of high quality printed copies.

7 Claims, No Drawings

PHOTOSENSITIVE MATERIAL FOR LITHOGRAPHIC PRINTING

FIELD OF THE INVENTION

The present invention relates to a photosensitive material for lithographic printing having excellent printing durability and more particularly, to a photosensitive material for electrophotographic lithographic printing which can provide a large number of clear printed copies.

BACKGROUND OF THE INVENTION

Conventional photosensitive materials for electrophotography using a flexible base such as a paper or a plastic film are comprised such that at least the layer contacting a photoconductive insulating layer has very low electrical resistance. Such a low electrical resistance layer is generally selected from a thin metal film (e.g. aluminum, copper, gold or silver), a carbon black containing layer or a low electrical resistance polymer layer. An aluminum foil is most conventionally used as a layer having low electrical resistance aand high uniformity.

The photoconductive insulating layer is prepared by applying a composition which is prepared by dispersing photoconductive particles in lipophilic resins such as silicone resins, acrylate resins, polystyrenes, polyvinyl acetates, polyvinyl chlorides, polybutyl methacrylates, polyvinyl butyrals or copolymers thereof, onto a substrate and drying it.

The photoconductive particles are the particles of photoconductive substances such as zinc oxide, cadmium sulfide, titanium dioxide, etc.

The ratio of the photoconductive particles to binder resin in the photosensitive layer is from 3:1 to 20:1 and the dispersion is applied on the substrate in an amount such that the resulting photosensitive layer has a dry thickness of 5 to 30 microns.

Printing with a lithographic printing plate by electrophotography is performed as follows. An image to be printed is formed on the photoconductive layer by either dry or wet development according to conventional electrophotographic methods. Then, the photoconductive layer on which the image has been formed is treated with a desensitizing (etching) solution to make the non-image area hydrophilic. In this case, the image area maintains ink sensitive. The thus treated lithographic printing plate is mounted on an offset printing machine and, as result, an oily ink is transferred to only the image area to provide a number of printed copy.

Thus, the lithographic printing plate is treated with a desensitizing (etching) solution and is immersed in damping water during printing. Therefore, the plate must have water resistance in order to provide a number of clean printed copies. Furthermore, it must have a smooth surface and sufficient adhesiveness in order to present peeling between layers constituting the plate. The plate is also required to retain its initial electrostatic characteristics and have good stability during storage.

If the damping water permeates into the paper base through the photosensitive layer during printing, the paper on the printing machine swells and sags to the extent such that the plate bends or breaks. Accordingly, sufficient printing durability cannot be maintained. In order to increase printing durability it is necessary to prevent the permeation of damping water into the paper through the photosensitive layer during printing.

Therefore, an aluminum foil having a thickness of 0.1 micron or more is desirably formed between the photosensitive layer and the paper base. The aluminum foil does not have substantial mechanical strength, but serves as a barrier to prevent permeation of damping water through the photosensitive layer and can increase the electroconductivity of the base. Therefore, the aluminum foil is believed to improve the image quality and also the printing durability of the plate.

However, the photosensitive material composed of a photosensitive layer, aluminum foil and paper base has poor adhesiveness between the photosensitive layer and aluminum foil. Therefore, when such photosensitive material is used as a photosensitive material for lithographic printing, peeling occurs between the photosensitive layer and aluminum foil after the printing of a few copies and a number of clear printed copies cannot be produced.

SUMMARY OF THE INVENTION

As a result of various studies to overcome defects in conventional photosensitive materials for lithographic printing by electrophotography, it has been found that photosensitive material for electrophotographic lithographic printing having excellent printing durability can be obtained with a material of a specific structure.

Therefore, an object of the present invention is to provide a photosensitive material for lithographic printing by electrophotography having excellent printing durability which comprises a photosensitive layer, an aluminum foil and a paper base in that order wherein an intermediate layer containing colloidal silica and/or colloidal alumina is formed between the photosensitive layer and the aluminum foil.

DETAILED DESCRIPTION OF THE INVENTION

The photoconductive layer which can be used in the present invention can be selected from conventional photoconductive layers.

A paper base is laminated with aluminum, and a layer containing colloidal silica and/or colloidal alumina is formed on the aluminum surface as an intermediate layer. If desired, another layer may be formed on at least one surface of the intermediate layer to improve the adhesiveness with respect to the photoconductive layer.

The intermediate layer according to the present invention is prepared by the following method: a resin binder for colloidal alumina and silica is dissolved in an aqueous medium or solvent; colloidal alumina and silica in the form of a powder of dispersion is introduced into the resulting solution; the mixture is stirred by conventional means, e.g., mixing with a propeller or dispersing with ultrasonic waves; and the resulting coating solution is applied onto the aluminum surface by conventional means.

The colloidal silica and colloidal alumina used in the present invention are commercially available as an aqueous dispersion of particles having a particle diameter of 1 to 100 $\mu$m. It is also possible to obtain such materials having high miscibility with organic solvents. Therefore, the resins used as the binder for the intermediate layer are not particularly limited.

Examples of the resins which can be used include polyethylene terephthalate, polyimide, polycarbonate, polyacrylate, polymethyl methacrylate, polyvinyl fluoride, polyvinyl chloride, polyvinyl acetate, polystyrene, styrenebutadiene copolymers, polymethacrylate, silicone resins, chlorinated rubber, epoxy resins, pure and modified alkyd resins, polyethyl methacrylate, poly-n-butyl methacrylate, cellulose acetate, ketone resins, polyethylene, polypropylene, polyacrylonitrile, rosin derivatives, polyvinylidene chloride, nitro cellulose, phenol-formaldehyde resins, m-cresol-formaldehyde resins, styrene-maleic anhydride copolymers, polyacrylic acid-polyacrylic acid amide copolymers, fumaric acid-ethylene glycol copolymers, methyl vinyl ether-maleic anhydride copolymers, acryloyl glycinevinyl acetate copolymers, polyvinyl pyrrolidone, polyvinyl alcohol, polyamide, halogenated styrene or the like.

The intermediate layer generally has a thickness of 0.01 to 10 μm.

If desired, a water-resistant electroconductive layer may be formed on the surface of the paper base opposite the surface on which the aluminum foil is formed.

Examples of such water-resistant electroconductive layer include a layer prepared by dispersing electroconductive particles such as carbon black, zinc oxide or tin oxide in a resin e.g., the resin binder used in the intermediate layer; a layer comprising a highly electroconductive charge transfer complex; a metallized film or foil; etc.

The plate for lithographic printing by electrophotography of the present invention has an intermediate layer containing colloidal alumina and/or silica and has the following advantages:

(1) The photoconductive layer is strongly adhered to the paper base by the intermediate layer so that stable photosensitivity image quality and printing durability can be obtained;

(2) A desired intermediate layer with good stability can be formed by simply evaporating the solvent from the coated solution and therefore the resulting plate maintains good quality for a long period of time;

(3) During printing, damping water does not reach the paper base through the photosensitive layer and the plate has an excellent printing durability; and (4) The elongation of the plate during printing is minimized so that printed copies having good quality can be produced.

The present invention is now described in greater detail by reference to the following examples to which the invention is by no means limited. Unless otherwise indicated, all parts are by weight.

EXAMPLE 1

An intermediate layer having the compositions shown below was coated on a paper base (103 g/m$^2$) laminated with an aluminum foil (10 μthick) to a thickness of 4 μm by a conventional method.

| | Parts |
|---|---|
| Colloidal alumina ("Alumina Sol 200" a product of Nissan Chemical Industries, Ltd.) | 50 |
| Polyvinyl acetate ($M\overline{w}$ = 80,000) | 100 |
| Methanol | 100 |

A photosensitive layer having the following compositions was coated on the surface of the intermediate layer to a dry thickness of 25 g/m$^2$.

| | Parts |
|---|---|
| Photoconductive zinc oxide ("Sazex 2000", a product of Sakai Chemical Industry Co., ltd.) | 100 |
| Silicone resin ("KR-211", a product of Shinetsu Chemical Industry Co., ltd.) | 15 |
| Rose bengale | 0.1 |
| Fluorescein | 0.2 |
| Methanol | 0 |
| Toluene | 50 |

The resulting photosensitive sheet was allowed to stand in a dark room at 40% R.H. and 25° C. for 12 hours. A printing plate was prepared from this sheet using Itek Model 135 electrophotographic printing plate making machine and an image of good quality was obtained. The plate was desensitized with an etching solution of Addressograph-Multigraph Corporation and set on an offset printing machine (Hamada Star 700). Even after 5,000 sheets were printed, no wrinkles developed, the photosensitive layer did not peel off from the paper base and no elongation of the plate occurred.

EXAMPLE 2

An intermediate layer having the compositions shown below was formed on the same base as used in Example 1 to a thickness of 6 μm by a conventional method.

| | Parts |
|---|---|
| Colloidal silica ("Snowtex-O", a product of Nissan Chemical Industries, Ltd.) | 20 |
| Colloidal alumina (alumina sol (15% aqueous dispersion), a product of Nissan Chemical Industries, Ltd.) | 50 |
| Cebian A (polyvinyl acetate emulsion, a product of Daicel Ltd.) | 150 |
| Water | 100 |
| Surfactant ("Amisole CDC", a product of Kawaken Fine Chemicals Co., Ltd.) | 0.1 |

The same photosensitive layer as in Example 1 was formed on the surface of the intermediate layer to a dry thickness of 20 g/m$^2$.

Using the sheet, a printing plate was prepared and subjected to printing in the same manners as in Example 1. Even after 8,000 sheets were printed, no wrinkles developed on the plate, the photosensitive layer did not peel off from the paper base and no elongation of the plate was observed.

EXAMPLE 3

Using the same photosensitive sheet prepared as in Example 2, a printing plate was prepared using Itek Model 135 electrophotographic printing plate making machine using a wet developer comprising polyvinyl acetate particles, alkali blue pigment, a lauryl methacrylate/diacetone acrylamide copolymer and a half-alkylamide product of diisobutylene/maleic acid copolymer ("Homogenol L-18", a product of Kao-Atlas Company, Ltd.). The plate was subjected to printing in the same manner as in Example 1. Even after 10,000 sheets were printed, no wrinkle developed on the plate, the photosensitive layer did not peel off from the base paper and no elongation of the plate was observed. All copies had good quality.

EXAMPLE 4

A photosensitive sheet was prepared in the same manner as in Example 1 except that on the other surface the paper which was not laminated with aluminum foil powders prepared by kneading a polyethylene and 15 wt% carbon black per the weight of the polyethylene were additionally coated by a conventional heat fusion method.

Using this sheet a printing plate was prepared in the same manner as in Example 3. When the plate was treated with an etching solution using a Ricoh etching machine, no plate deformation such as curling occurred.

The plate was subjected to printing. Even after 10,000 sheets were printed, no wrinkles developed on the plate, the photosensitive layer did not peel off from the base paper and no elongation of the plate was observed. All copies had good quality.

While the invention has been described in detail and with reference to specific embodiments thereof, it will be apparent to one skilled in the art that various changes and modifications can be made therein without departing from the spirit and scope thereof.

What is claimed is:

1. A photosensitive material for lithographic printing, comprising:

a paper support base;

an aluminum foil layer positioned on a surface of the support base, an intermediate layer comprising particles selected from the group consisting of colloidal silica particles colloidal alumina particles and mixtures thereof the intermediate layer positioned on the aluminum foil layer wherein the intermediate layer has a thickness from about 0.01 to 10 μm; and a photoconductive layer positioned on the intermediate layer.

2. A photosensitive material as claimed in claim 1, further comprising:

a layer having electroconductive particles dispersed in a resin formed on a surface of the paper support base opposite the surface coated with the aluminum foil.

3. A photosensitive material as claimed in claim 1, further comprising:

a layer comprising a highly conductive charge transfer complex formed on a surface of the paper base opposite the surface coated with the aluminum foil.

4. A photosensitive material as claimed in claim 1, further comprising:

a layer comprising a metalized film formed on a surface of the paper base opposite the surface coated with the aluminum foil.

5. A photosensitive material as claimed in claim 1, further comprising:

a layer comprising a foil formed on a surface of the paper base opposite the surface coated with the aluminum foil.

6. A photosensitive material for lithographic printing as claimed in claim 1, wherein the particles have a particle diameter of from 1 to 100 μm.

7. A photosensitive material for lithographic printing as in claim 1, wherein said intermediate layer comprises a mixture of colloidal silica particles and colloidal alumina particles.

* * * * *